US006725797B2

(12) United States Patent
Hilleman

(10) Patent No.: US 6,725,797 B2
(45) Date of Patent: Apr. 27, 2004

(54) METHOD AND APPARATUS FOR PROPELLING A SURFACE SHIP THROUGH WATER

(76) Inventor: Terry B. Hilleman, 1911 Knollwood Dr., Marshalltown, IA (US) 50158

( * ) Notice: Subject to any disclaimer, the term of this patent is extended or adjusted under 35 U.S.C. 154(b) by 0 days.

(21) Appl. No.: 10/171,273

(22) Filed: Jun. 12, 2002

(65) Prior Publication Data

US 2002/0185050 A1 Dec. 12, 2002

Related U.S. Application Data

(63) Continuation-in-part of application No. 10/164,730, filed on Jun. 6, 2002, and a continuation-in-part of application No. 09/718,753, filed on Nov. 22, 2000, now Pat. No. 6,427,618.

(60) Provisional application No. 60/361,950, filed on Mar. 7, 2002, provisional application No. 60/297,314, filed on Jun. 12, 2001, and provisional application No. 60/167,464, filed on Nov. 24, 1999.

(51) Int. Cl.[7] ..... B63G 8/08

(52) U.S. Cl. ..... 114/337; 114/151; 440/38; 440/47

(58) Field of Search ..... 114/338, 151, 114/68 R; 440/47, 68, 38

(56) References Cited

U.S. PATENT DOCUMENTS

| | | | |
|---|---|---|---|
| 3,430,602 | A | 3/1969 | Greiner |
| 3,469,555 | A | 9/1969 | Greiner |
| 3,476,072 | A | 11/1969 | Wilson |
| 3,509,721 | A | 5/1970 | Crawford |
| 3,587,511 | A | 6/1971 | Buddrus |
| 3,596,626 | A | 8/1971 | Buddrus |
| 3,599,595 | A | 8/1971 | James |
| 3,606,857 | A | 9/1971 | Sundquist |
| 3,646,903 | A | 3/1972 | Hansson |
| 3,673,978 | A | 7/1972 | Jeffery |
| 3,709,186 | A | 1/1973 | Gotmalm |
| 3,714,920 | A | 2/1973 | Setterblade |
| 3,779,199 | A | 12/1973 | Mayer |
| 3,831,546 | A | 8/1974 | Geres |
| 3,838,654 | A | 10/1974 | Haas |
| 3,847,107 | A | 11/1974 | Buddrus |
| 3,915,111 | A | 10/1975 | Buddrus |
| 3,951,097 | A | 4/1976 | Clark |
| 3,973,392 | A | 8/1976 | Hallqvist |
| 3,983,833 | A | 10/1976 | Eickmann |
| 4,051,679 | A | 10/1977 | Collin |
| 4,220,110 | A | 9/1980 | Roberson |
| 4,316,722 | A | 2/1982 | Aschauer |
| 4,346,662 | A | 8/1982 | Rogers |
| 4,412,500 | A | 11/1983 | Krautkremer |
| 4,641,559 | A | 2/1987 | Castiglioni |
| 4,680,017 | A | 7/1987 | Eller |

(List continued on next page.)

*Primary Examiner*—Jesus D. Sotelo
(74) *Attorney, Agent, or Firm*—McKee, Voorhees & Sease, P.L.C.

(57) ABSTRACT

A method and apparatus for propelling a surface vehicle through the water comprised of a submerged portion, including both a stern propulsion unit and a bow propulsion unit. Either unit may be a pumpjet, the bow unit may include a counter-rotating nose hub having attached spirally wound, twin centrifugal propeller blades. The foremost bow propeller is dedicated to stealth and the next-in-line bow propeller is dedicated to supercavitation. Specially-designed vortex loops that connect the pressure side to the intake side of a propulsion unit may be included in the blades, shroud or hub areas. Further, slightly diverged jet exhaust and variable special surface texturing reduce surface friction drag on the vehicle body. The submarine propulsion system is used to power a surface vessel, supported by two or more hydrofoils which combine a submerged midcraft foil with a wave-piercing variety. The surface craft has the capability of submerging and maneuvering.

26 Claims, 7 Drawing Sheets

U.S. PATENT DOCUMENTS

| | | | |
|---|---|---|---|
| 4,681,508 | A | 7/1987 | Kim |
| 4,819,576 | A | 4/1989 | Shaw |
| 4,831,297 | A | 5/1989 | Taylor |
| 4,842,560 | A | 6/1989 | Lee |
| 4,871,332 | A | 10/1989 | Rodriquez |
| 4,902,254 | A | 2/1990 | Chas |
| 4,962,718 | A | 10/1990 | Gornstein |
| 4,981,099 | A | 1/1991 | Holder |
| 5,016,553 | A | 5/1991 | Spencer |
| 5,181,478 | A | 1/1993 | Berardi |
| 5,203,274 | A | 4/1993 | Hart |
| 5,252,875 | A | 10/1993 | Veronesi |
| 5,339,761 | A | 8/1994 | Huang |
| 5,355,827 | A | 10/1994 | Barbazash |
| 5,359,958 | A | 11/1994 | Guild |
| 5,383,801 | A | 1/1995 | Chas |
| 5,392,871 | A | 2/1995 | McFarland |
| 5,438,947 | A | 8/1995 | Tam |
| 5,503,100 | A | 4/1996 | Shaw |
| 5,520,137 | A | 5/1996 | Arii |
| 5,551,369 | A | 9/1996 | Shen |
| 5,601,047 | A | 2/1997 | Shen |
| 5,634,419 | A | 6/1997 | Cymara |
| 5,645,008 | A | 7/1997 | Loui |
| 5,722,864 | A | 3/1998 | Andiarena |
| 5,794,558 | A | 8/1998 | Loui |
| 5,813,358 | A | 9/1998 | Roccotelli |
| 5,813,361 | A | 9/1998 | Milliman |
| 5,813,887 | A | 9/1998 | Mark |
| 5,879,207 | A | 3/1999 | Edmon |
| 6,058,872 | A | 5/2000 | Latorre |
| 6,427,618 | B1 | 8/2002 | Hilleman |

METHOD AND APPARATUS FOR PROPELLING A SURFACE SHIP THROUGH WATER

CROSS-REFERENCE TO RELATED APPLICATIONS

This application is a CIP of U.S. patent application Ser. No. 10/164,730 filed Jun. 6, 2002, which claims the benefit of U.S. Provisional Application Ser. No. 60/297,314 filed Jun. 12, 2001, the benefit of U.S. Provisional Application Ser. No. 60/361,950 filed Mar. 7, 2002 and is a CIP of U.S. patent application Ser. No. 09/718,753 filed on Nov. 22, 2000, now issued as U.S. Pat. No. 6,427,618, which claims the benefit of U.S. Provisional Application Ser. No. 60/167,464 filed Nov. 24, 1999 all of which are herein incorporated by reference.

BACKGROUND OF THE INVENTION

1. Field of the Invention

The present invention relates to aquatic propulsion systems and more specifically to a generally submerged propulsion system for a surface ship.

2. Problems In The Art

Underwater vehicles, such as submarines, are currently pushed through the water using propeller-based propulsion system typically located at the stern of the vehicle. Drag forces acting on the vehicle cause the water in front of, and around the vehicle, to become displaced and turbulent in nature. These drag forces lead to decreased efficiency and a lower overall thrust. Further, such propeller-based propulsion systems cause an increase in the submarine's noise with an associated increase in speed. This may aid others in detecting the submarine, enabling its destruction.

The increase in noise is due largely to cavitation. Cavitation is the formation of water vapor bubbles caused by rapid propeller movement that creates a vacuum-like area in the incompressible water. The vapor pressure of the water forms a bubble. Surrounding water pressure soon violently collapses the bubble creating substantial noise.

As the speed of the submarine increases, a geometrically increasing wave generated by frontal water resistance limits the increase in speed and contributes to increased cavitation. This wave is the main resistance to high speed travel in surface vessels and plays a role in submarine speed, albeit less when the submarine is at a depth of greater than three submarine diameters below the surface.

In addition, as submarine speed increases, surface friction from turbulence-related viscous shear stress creates a boundary layer of retarded fluid along the surface of the moving vessel. In this boundary layer, eddies of high-speed fluid contact the surface, causing deceleration, sapping the watercraft's momentum. This boundary layer turbulence increases in magnitude as flow progresses rearward from the bow. Thus nearly all of the vehicle's surface boundary layer is turbulent. The friction or drag of a turbulent boundary layer is seven to ten times that of a laminar boundary layer, so the possibility of achieving significant reductions in vehicle drag by boundary layer management is attractive.

There have been attempts to reduce boundary layer friction on submarines. For example, in U.S. Pat. No. 4,346,662 to Rogers, a twin hull design incorporates extensive slots in the outer hull. These are kept open by a back-flush pump in the bow at low speed. At high speeds, the bow pump is inactivated while the main pump at the stern exhausts water that has been pulled through the slots by suction. This is the sub's main propulsion. However, high Reynolds numbers (friction) limited practical application.

U.S. Pat. No. 3,779,199 to Mayer also discusses boundary layer control. Mayer did not solve the boundary layer problem beyond the bow, where the problem mainly exists. The Mayer patent eliminated the conventional propeller and rudder. However, such an arrangement loses efficiency due to poor management of the slipwater at the stern. The small intake diameter at the bow end did not approach the submarine diameter. The water exited through a large number of exit ports behind the intake in the bow region. The large numbers of parallel bow exit slots were arranged in a number of concentric rings. These were used for directional flow and as the only source of propulsion. Due to aforementioned reasons, the Mayer patent was not utilized in a practical submarine application.

Short of eliminating surface resistance and wave generation by other means, stealth submarine speed is slow, and top speed is below that of important surface ships, such as an aircraft carrier. Submarine surfaces are presently coated with rubber to make it less reflective to sonar and mute submarine noise. Stealth is the priority with submarines, it has always been the priority.

Surface water vehicles typically rely on a propeller fan, either by an inboard or outboard stern positioned engine, for propulsion. This application of power to the rear end creates an inverted pendulum, with stability problems. Further, a stern drive arrangement requires the vehicle to be pushed through the water, causing geometrically disproportionate wave drag with any increase in speed. This wave arises from displacing all the water in front of the vehicle, to areas around and behind the vehicle, limiting stability, efficiency and speed. Currently, improved water jet engines are placed at the stem of craft that exhaust the water jet outward, above the waterline. However, they are still subject to the preceding limitations of stem-drive only. They are a variation of the original water-jet engine that accelerates water through a curved passageway. Attempts have been made to address these problems for surface water vehicles. For example, U.S. Pat. No. 5,634,419 to Cymara discloses what is called a "front-drive boat" wherein a propeller propulsion system is located towards the front (bow) of the boat, which is claimed to increase stability of the boat. It corrects the problem of power to an inverted pendulum.

Further, U.S. Pat. No. 4,680,017 to Eller, entitled "Motorboat Propeller Guard For Improved Performance", places a propeller inside a housing with grids configured to attempt to direct propelled water rearward for improved performance (higher speed). It is a jet-like stem drive system. Similar designs, including the stem pumpjet used on modem stealth submarines, follow earlier torpedo pumpjet designs. Cavitation (generation of noisy water vapor bubbles) was reduced in the pumpjet through pressurizing the propeller blade areas and eliminating the propeller tip vortices, making higher speeds at stealth possible. Herein incorporated by reference, U.S. Pat. Nos. 5,383,801 to Chas, U.S. Pat. No. 4,902,254 to Chas, and U.S. Pat. No. 4,831,297 to Taylor et al., disclose propulsion systems for over the water craft that adopt jet engine principles to attempt to increase propulsion. Another propeller based propulsion system is U.S. Pat. No. 5,252,875 to Veronesi, et al, herein incorporated by reference.

Many of the above patents resemble a jet engine in appearance and further resemble a jet engine in the manner in which they are attached to a vehicle; i.e. they hang down from the craft. However, they still have to push a boat through the water, causing wave displacement that increases geometrically with speed, none have twin jet accelerators in sequence and none of the above referenced patents are capable of supercavitation. Currently, only munitions, including rocket powered blunt-nosed torpedoes and high-velocity blunt nosed supercavitating bullets, are capable of any sustained supercavitation. However, the rocket or explosive style propulsion systems have limited range and would be very dangerous for use in passenger travel. There is another patent that deals with decreasing drag to improve stealth and speed. It involves two or more propulsion units in sequence (stages)to power a submarine. A preferred embodiment discusses a two-stage bow propulsion system combined with a conventional stem propeller. The bow stage one vanes and stage two vanes can be selectively employed, individually, or in combination. The two bow stages allow a choice between supercavitation (very fast and noisy), or higher speed stealth (faster silent running) propulsion.

Engaging both twin bow stages on the jet-drive submarine and/or torpedo in U.S. Pat. No. 6,427,618 B1 by Hilleman offers a supercavitating generation platform. Water is incompressible; it is a high-pressure to high-velocity device. The first bow stage minimizes cavitation while it propels the submarine through the water and feeds the second stage. The bow second-stage propeller's high velocity, combined with the enclosing shroud, the shroud's trailing edge, high-speed lower-pressure nozzle emission, and water vapor pressure, can create a large long vapor cavity (supercavity). The radial velocity of the tangential-to-flow movement of the stage two vanes can easily achieve speeds of 50 meters per second, to initiate the process of supercavitation, without the need for the submarine itself to reach this speed. This would allow the submarine to smoothly transition to high speed. Supercavity formation around the hull would eliminate surface drag, by placing the hull in a water vapor vacuum cavity.

Wave generated drag is also eliminated, by using the displaced water that causes a frontal wave, to generate the supercavity. Water has to be accelerated to move any craft; there will be nozzle friction loss from resistance, regardless of nozzle location on the craft. Using the bow water that has to be displaced (to allow forward movement), to flow through the propulsor, places the energy of propulsion in an effective location. The frontal wave is incorporated into the resistance of the propulsion system, resulting in less total resistance. As long as the flow of water into the intake is greater than the submarine speed, there will be very little frontal wave generation. The result of less resistance is more speed for a given mass, using the same input energy.

When the supercavitating vanes are deactivated, the nearly straight through flow around the low pitch stationary stage two vanes offer little resistance as the water moves from the stage one propeller to the jet nozzle region. Speed of stealth is increased at speeds below the initiation of cavitation, due to the elimination of frontal wave resistance and also by directing the jet to slightly diverge away from the submarine surface, (to reduce boundary layer problems).

There is also a reduced potential for cavitation in the stage one bow propeller. The stage one blades are increasingly pressurized on their front face as forward speed is moderately increased; however, care must be taken so that increased blade speed does not also increase blade cavitation overall. The blade pressure increase with moderate increased speed retards cavitation on the front face of the stage one blades. As previously discussed, the rate of intake will affect the amount of pressure on the stage one blade faces; i.e. the more the frontal wave is reduced by moving it through the propulsor, the lower the pressure on the frontal blade face will be. Restriction to flow from nozzle friction also suppresses cavitation by pressurizing the back face and tips of the bow propulsor stage one vanes.

This is in sharp contrast to the cavitation seen on conventional submarine stem propulsion, where the suction magnitude in the turbulent stem slipwater increases with speed, which in turn, further increases the potential for cavitation at lower blade speeds. In this embodiment the stem propulsion was nevertheless retained to manage the slipwater suction turbulence and assist propulsion.

Unfortunately, a present state-of-the-art nuclear submarine costs billions of dollars and it takes around ten years to plan and build. Adapting the supercavitating design may even be more costly and time-consuming, due to the major design changes. In addition, the submarine may need to run near the surface to ventilate the supercavity, so as to enhance the cavity's stability.

Reduction of frontal wave drag and boundary layer drag with surface ships can be attained by raising the surface ship above the water. The speed of surface vessels is improved by the use of hydrofoils; however, speeds, although increased, are limited due to major instability problems and weight considerations. U.S. Pat. No. 5,813,358 to Roccotelli, entitled "Surface-Piercing Surface Effect Marine Craft," uses aerodynamic lift to support the weight of the craft (flying wing), and reduces the immersed parts to a bare minimum in an effort to achieve propulsion and attitude control. U.S. Pat. No. 6,058,872 by Latorre, tries to accomplish the same, using a Catamaran, combining both aerodynamic and hydrodynamic lift.

U.S. Pat. Nos. 5,601,047 and 5,551,369 to Shen shows a supercavitating hydrofoil, which also works at subcavitating speeds. Very high speeds should be attainable by craft driven to supercavitation velocity, as long as the craft remains aloft, supported by the dual-cavitating hydrofoils, and the propulsion does not cause instability (by being above the water). This can be a problem in rough seas. When a hydrofoil is foil-borne, the foils carry 100% of the displacement of the foil craft. If the flow of water over one or more of the foils is interrupted by sea conditions, or flow is detached from stalling or ventilation, the entire hydrofoil is at risk of crashing.

Instability at high speed is also a problem with U.S. Pat. No. 5,359,958 by Guild in the gas-turbine powered "High Speed Watercraft." This ocean racer is a hydroplane and it almost approaches supercavitation speed. However, it can be very unstable in turns and in rough seas. Gornstein discusses dual propulsion and hydrofoils in U.S. Pat. No. 4,962,718. As the boat transitions from a water-supported hull, powered by a propeller, to a foil supported craft, an air propeller assumes the task of propulsion. Above-the-water propulsion is unstable.

All present high-speed watercraft are top-heavy and very unstable at high speed. Stability is inversely related to speed. Safety is the major concern. Some time ago the Navy halted all high-speed applications for this reason. They are now re-examining the possibility of deploying troops and tonnage rapidly over water, as the need exists. There is therefore a need for the propulsor to be deeper in the water, providing power in the area of greater resistance, thereby increasing stability and safety.

U.S. Pat. No. 4,981,099 by Holder recognizes the advantage of submerging the propulsion system underwater, i.e. to eliminate bulk necessary for hydrofoil support above water. Four hundred tons is near the practical limit for hydrofoil support. Tonnage increases cubically with increased dimensions, while lifting force of the hydrofoil increases squarely with increased dimensions. U.S. Pat. Nos. 5,503,100 and 4,819,576 by Shaw discuss a hybrid water vessel that comprises a submarine, hydrofoil, and surface ship. One embodiment even discusses a propeller on the front of a submarine, but it is not the twin jet drive of U.S. Pat. No. 6,427,618 by Hilleman, herein incorporated by reference.

Even a reduction of water drag is an advantage. Barbazash, as well as in U.S. Pat. Nos. 5,794,558 and 5,645,008 by Loui, discusses this concept in U.S. Pat. No. 5,355,827. Here improved hydrofoil design supports 70percent of the ship's weight amidship. It does not lift the surface craft out of the water; however it does raise it somewhat, reducing water displacement and wave drag.

The hydrofoil stability problem has recently been greatly overcome by constantly ventilating the wave-piercing or surface-skimming hydrofoil in U.S. Pat. No. 6,095,076 to Nesbitt. However, small vessel size restriction remains a limitation. Although a great improvement, this fore and aft improved hydrofoil-supported craft is still top-heavy, as substantially all of the weight of the craft is above the water at speed. This is still potentially unstable at high speed and does not lead to good seakeeping in troubled seas. That is unacceptable in a warship; it is even risky in a high-speed ferry.

Therefore, although attempts have been made to increase the speed of surface vessels by the use of hydrofoils and hydroplanes, both size and stability are a problem. Submerging the power plant was a partial solution to the problem, but even though the submarine profile has less water drag than a surface vessel, neither the higher speed provided by supercavitation, nor higher speed at stealth was possible.

Present-day supercavitating propellers are designed for forward speed and are considered incapable of generating a supercavity of any size or stability. However, U.S. Pat. No. 4,681,508 by Kim deals with propeller design to create streamlined supercavitation flow in a centrifugal pump. It generates high suction pressure and has powerful gas and vapor expulsion abilities. It is not only free from cavitation erosion, but also free from the abrasion, damage, or destruction caused by solid matters or gases in the lifting or driving fluid. This design is capable of large supercavity generation and accomplishes this without extreme high speed of rotation or great expenditure of power. The problem with it is that it cannot provide workable forward propulsion in a watercraft. It could be integrated into the twin-jet bow propulsion system discussed previously. The ability to manage some incoming gas makes it particularly attractive.

There is therefore a need to incorporate an unmanned submarine supercavitation propulsion system with a hydrofoil-supported surface craft. In this case, the frontal wave drag and surface friction drag would be minimized, and the resulting stability from a propulsor located deeper in the water could provide improved safety and seakeeping at higher speeds during unfavorable conditions.

In addition, the top speed of present-day stealth surface ships is very low; this limits their applications. Any increase in speed at stealth would be advantageous. Present-day SWATH (small waterplane area twin hull) stealth ships are designed to minimize wake signature. Quiet running on a hydrofoil at stealth speed leaves even less wake than a present-day SWATH stealth ship. Ship profile above water is detected by radar. Submerging the propulsion system reduces the profile supported by the hydrofoil above the water, and can contribute to quieter running. A selective supercavitation option could adapt a sprint-and stealth pattern used by modern submarines. There is therefore a need for a submarine-powered propulsion system which can increase speeds at stealth on a surface ship.

Features of the Invention

A general feature of the present invention is the provision of a method and apparatus for propelling a surface ship through water which overcomes problems found in the prior art.

Another feature of the present invention is the provision of a method and apparatus for propelling a surface ship through water wherein a reduction of drag is caused by decreased surface turbulence along the length of the craft.

A further feature of the present invention is the provision of a method and apparatus for propelling a surface ship through water wherein the reduction of drag is caused by decreased wave generation.

Another feature of the present invention is the provision of a method and apparatus for propelling a surface ship through water that provides higher speed at stealth.

A still further feature of the present invention is the provision of a method and apparatus for propelling a surface ship through water that is faster than existing designs, capable of generating a supercavity and traveling in it.

A further feature of the present invention is the provision of a method and apparatus for propelling a surface ship through water that is more efficient at high speed, saving fuel by lowering drag.

A still further feature of the present invention is the provision of a method and apparatus for propelling a surface ship through water which uses one or more propellers to form a jet drive on the bow of an unmanned submersible propulsion system, in combination with a stem propeller or pumpjet.

Another feature of the present invention is the provision of a method and apparatus for propelling a surface ship through water wherein a submersed propulsion system supports a surface craft on streamlined struts.

Another feature of the present invention is the provision of a method and apparatus for propelling a surface ship through water including a propulsion system which may be maintained while underwater, to raise a surface craft above the water, using hydrofoils.

Yet another feature of the present invention is the provision of a method and apparatus for propelling a surface ship through water that combines an underwater mid-craft foil with a wave-piercing or surface-skimming hydrofoil, in order to increase the size and stability of the craft.

Still another feature of the present invention is the provision of a method and apparatus for propelling a surface ship through water which is more stable, at all speeds, yet very maneuverable.

Another feature of the present invention is the provision of a method and apparatus for propelling a surface ship through water while providing greater safety for the crew through the utilization of twin submarine fore and aft propulsor redundancy, along with a still further surface propulsion option.

An additional feature of the present invention is the provision of a method and apparatus for propelling a surface ship through water that demonstrates a resistance to sinking with a compromised hull, compromised superstructure, or compromised propulsion system.

Yet another feature of the present invention is the provision of a method and apparatus for propelling a surface ship through water with the capability for increased stealth through completely submerging and maneuvering the surface vessel portion below the waterline.

As still further feature of the present invention is the provision of a method and apparatus for propelling a surface ship through water including a safer location for fuel storage.

These, as well as other features and advantages of the present invention, will become apparent from the following specifications and claims.

BRIEF SUMMARY OF THE INVENTION

The present invention generally comprises a propulsion system for a submarine-powered surface vehicle. The submarine propulsion system generally comprises at least two propellers, mounted on a hub, the foremost located in a shroud on the bow end, which forces water into an inlet and out an outlet through a nozzle, thereby increasing the waters velocity and thereby producing a propelling force. It is a plug-type nozzle jet, formed by the shroud and body of the submarine. The jet exhaust is slightly diverged away from the exterior of the submarine. This divergence minimizes boundary layer friction drag and creates a counter-current turbulence in a positive direction. This jet propelling force can reduce frontal drag to increase speed at stealth, or generate a supercavity, permitting nearly drag-free very high speeds. Surface modification may also decrease surface drag (below the speed of cavitation), to complement the reduced frontal drag, thereby increasing the speed of stealth.

The unmanned submarine is attached, via streamlined struts, to a surface craft, engineered primarily for stealth and superior seakeeping. A SWATH (small-waterplane area twin-hull) craft has two submarines, one under each hull, connected by streamlined struts. A submerged, mid-craft hydrofoil supports the majority of the surface craft's weight while underway. It connects the twin submarine propulsion systems below the SWATH vessel. Wave-piercing or surface-skimming fore and aft hydrofoils, contribute support to a minor portion of the surface craft's weight while underway, providing surface stability at speed. Because the wave-piercing (surface-skimming) hydrofoils are continually ventilated by the atmosphere, there is a unique cavitation and stability advantage with the combined use of two types of foils at stealth speed. The two types of hydrofoils support the surface craft above the water on streamlined struts at speed; however, the submarines and mid-craft foil remain submerged, adding significant underwater mass and stability at speed. When the surface craft is in bad seas or cruising at slow speed, the stable, small waterplane hull configuration supports the craft lower in the water. The submarine(s), along with the mid-craft foil, act as a keel, minimizing both pitch and roll, to further enhance good seakeeping. Having the propulsion system lower in the water is more stable at all speeds, than any location on or above the surface; it places the source of propulsion farther into the area of greatest resistance.

DETAILED DESCRIPTION OF THE INVENTION

The present invention will be described as it applies to its preferred embodiment. It is not intended that the present invention be limited to the described embodiment. It is intended that the invention cover all modifications and alternatives, which may be included within the spirit and scope of the invention.

The present invention generally includes any submarine/hydrofoil/surface ship combination having one or more propulsion systems located in the bow area of the submarine portion, along with another propulsion system in the stern area of the submarine portion. Selective engagement of the propulsors can either increase speed at stealth or create supercavitation for high speed travel.

The submarine bow propulsion system is preferably a propeller-based system. A shroud encloses the propeller system to form a jet, using the submarine body to form the plug-type-nozzle commonly known in the art. The first propeller (stage one) is preferably a pumpjet. This pumpjet can be an arrangement of blades attached from a hub to a rotating shroud. The shroud is preferably dynamically shaped to provide an inlet and outlet for water and an airfoil/hydrofoil effect around the outside periphery. It is preferably similar to a circular airplane wing, but may be more heavily constructed for strength. Generally, the trailing edge is shaped (rounded) to minimize cavitation at stealth speed.

In one embodiment, the pumpjet blades are at or near the water inlet to the shroud. The pumpjet blades accelerate water passing through the inlet. Water is then forced into a nozzle region defined by the shroud and remaining body of the submarine. During normal operation, it is desirable to have the stage one pumpjet engaged at all times, for both stealth and speed.

Figure 1:
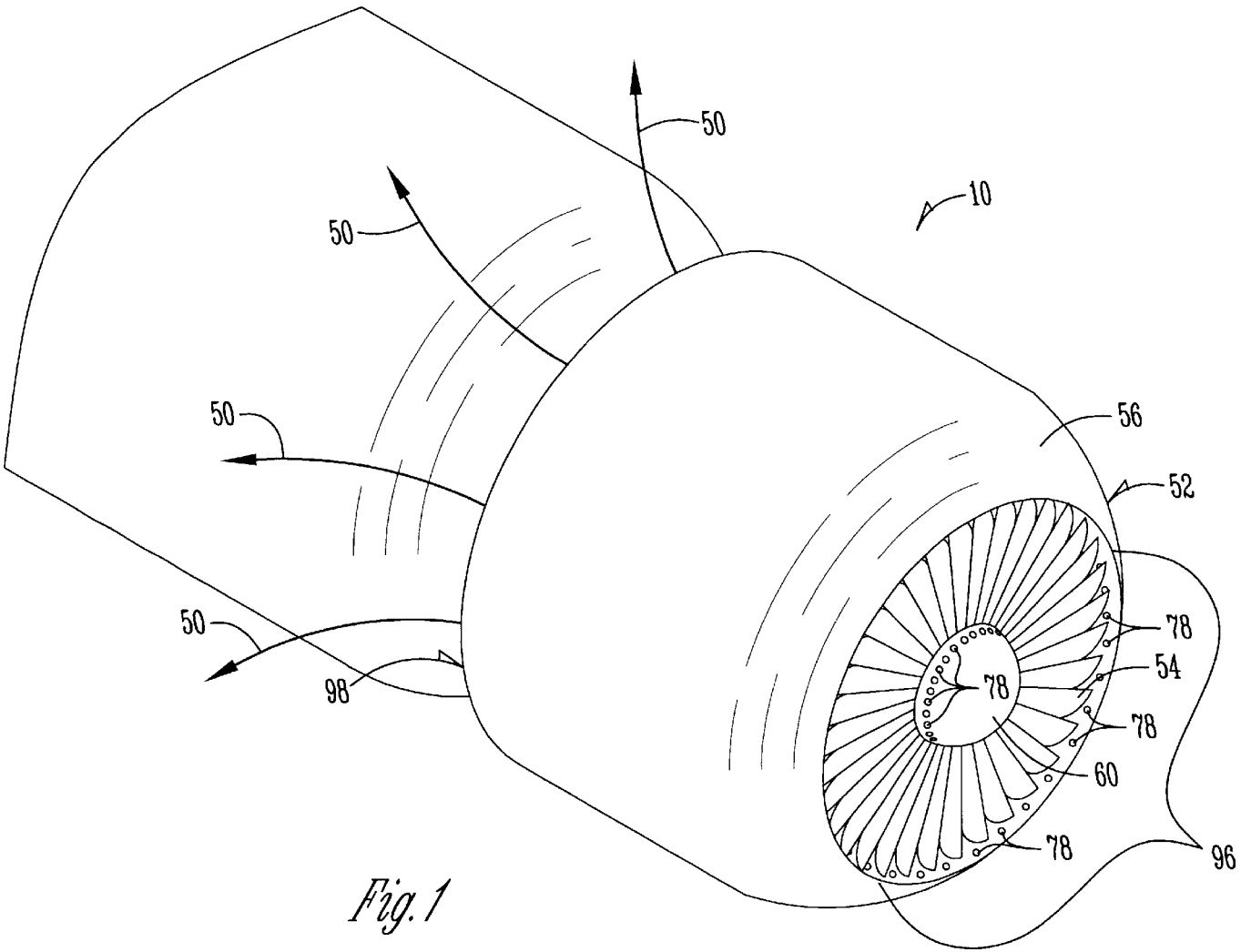
FIG. 1 is a pictorial angled fore view of the submarine pumpjet and submarine.

Referring to the drawings, FIG. 1 illustrates an angled fore-view of a submarine 10 incorporating a pumpjet 52 located at the very bow 14 of submarine 10. As is illustrated in FIG. 1, almost the entire front of the submarine is an inlet 96 for water. Pumpjet unit 52 has a hub 60, which is secured to a driveshaft, which is powered by the engine located within the submarine 10. A plurality of vanes 54 are positioned on hub 60. A fluid pathway exists between a front inlet 96 and back outlet 98 through the spaces between pumpjet blades 54. The driveshaft's spin turns the pumpjet unit 52, which in turn adds momentum to the water in the inlet.

Figure 2:
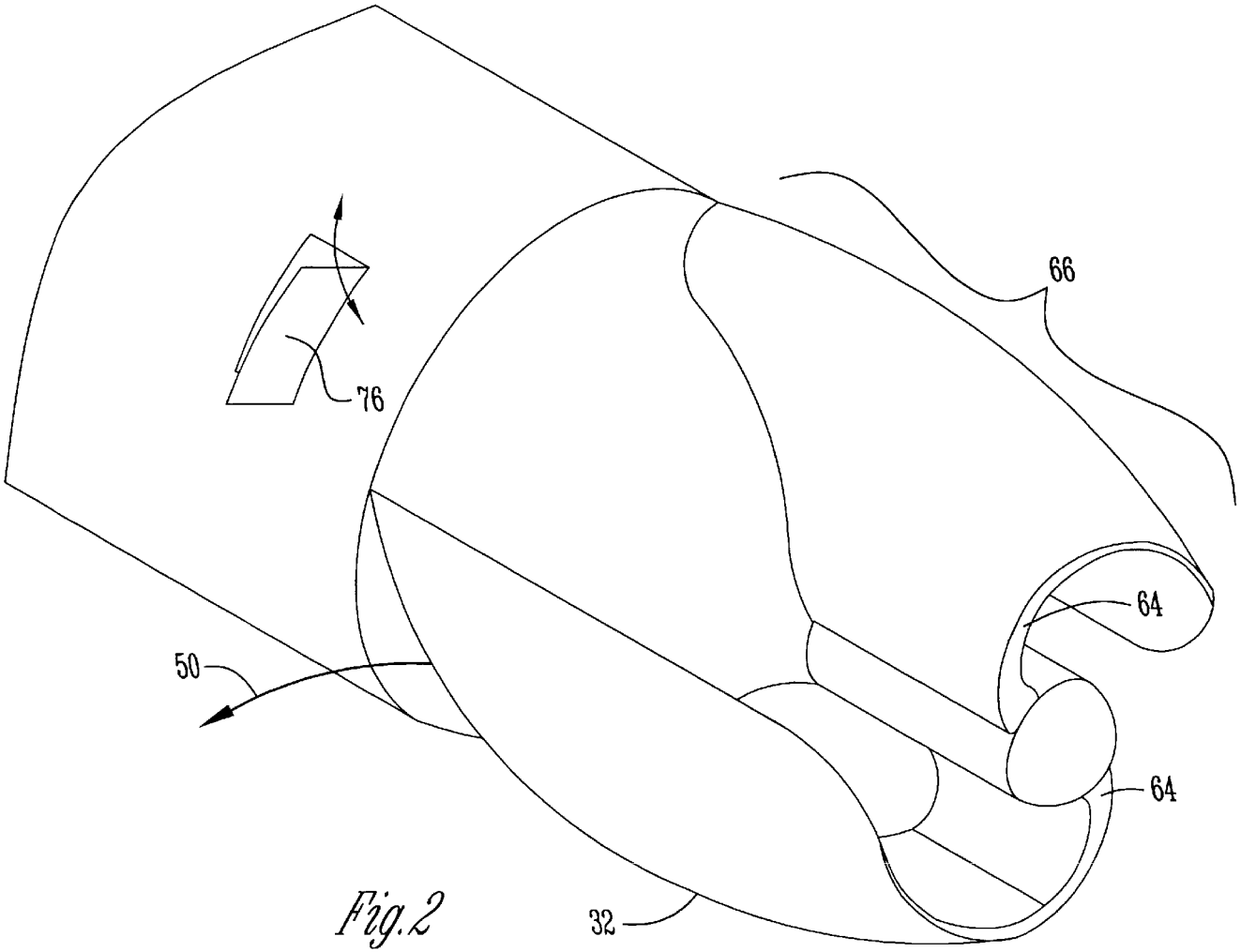
FIG. 2 is a pictorial angled fore view of the supercavitator hub and submarine.
Figure 4:
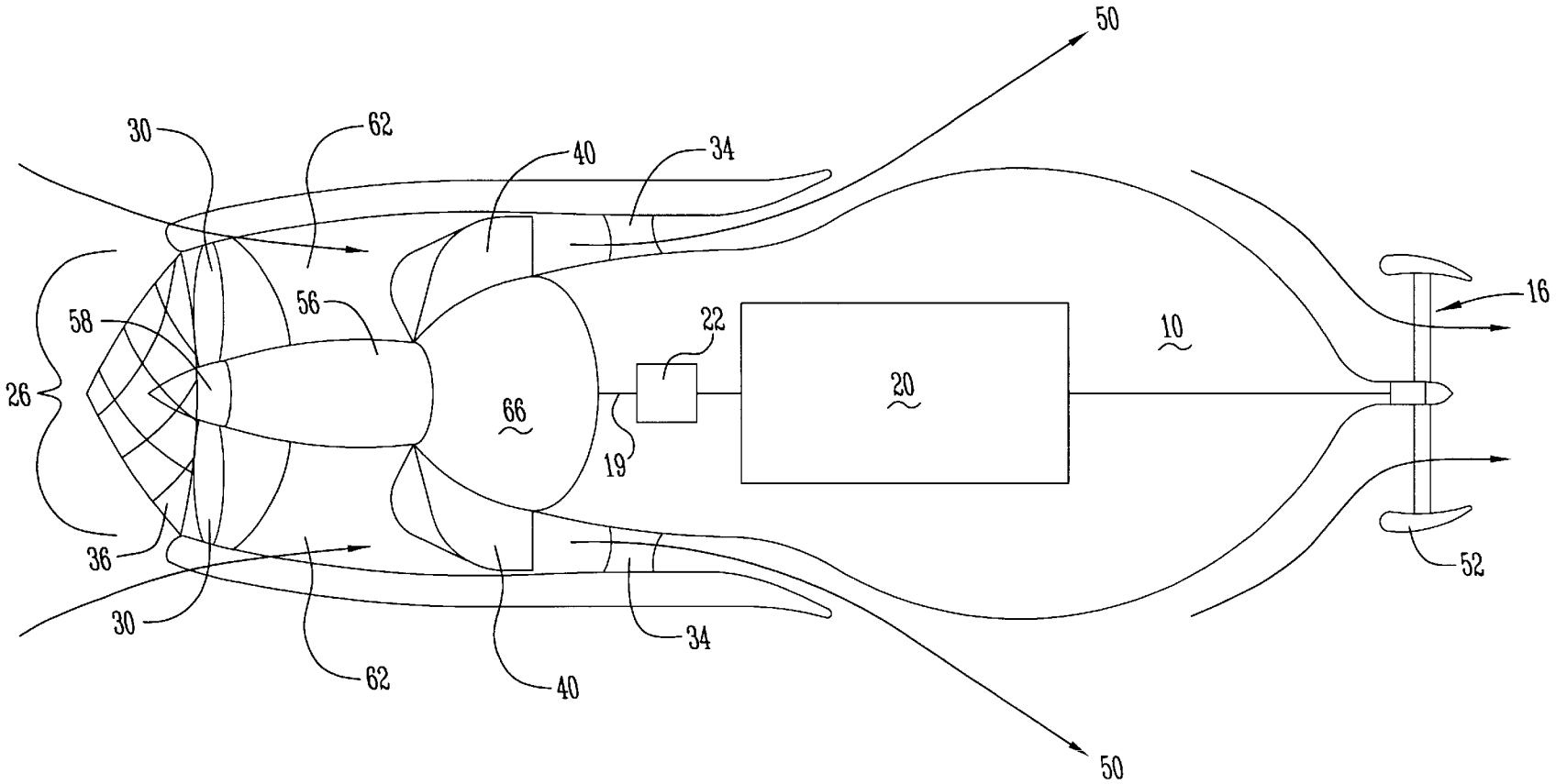
FIG. 4 is longitudinal side elevational view of an alternative embodiment of the supercavitator hub and submarine.

If higher speed is necessary, the stage two-supercavitating hub is activated. It may or may not be counter rotating. This stage two hub comprises the nose of the submarine (figures two and four). One or more blades 32 (FIG. 2) are spirally wound and attached to the stage two hub 66. The blades provide clearance from the shroud, so any debris that passes the pumpjet blades of stage one is easily carried through the jet. Upon the application of power from the turbine, through a drive shaft, to the spiral-bladed hub 66 of stage two, spiral-bladed hub 66 spins. This spin turns the propellers 32, which in turn adds additional momentum to the water in the area enclosed within the pumpjet shroud. This twice-accelerated water vaporizes and flows past the spirally wound supercavitating blades into the nozzle region 50 (FIGS. 1, 2 and 4). The nozzle region 50 is dynamically designed to provide maximum thrust. This nozzle 50 resembles the nozzle region for the secondary stream of airflow found in high-bypass jet engines.

In other words, combined with the forward propulsion of the stage one pumpjet, the stage two centrifugal-force hub generates a supercavity from the water taken through the two stages. In operation, the propeller blades 32 (FIG. 2) are spun on the hub 66 at a rate exceeding 50 meters/second, generating the formation of a supercavity, and thereby creating a "bubble" exhaust jet. This oversized bubble of vaporized water is then forced into the nozzle region defined by the shroud and remaining body of the submarine. The trailing edge of the shroud, along with lower pressure from rapid water acceleration through the nozzle, further enhances the supercavity. The supercavity envelops the entire submarine, including the stern propeller. The size of the submarine should be as large as the supercavity can reliably cover. Ventilating or supplementing the supercavity with additional gas from a compressor, or surface turbine exhaust gas, can greatly increase the size and stability of the supercavity.

Figure 3:
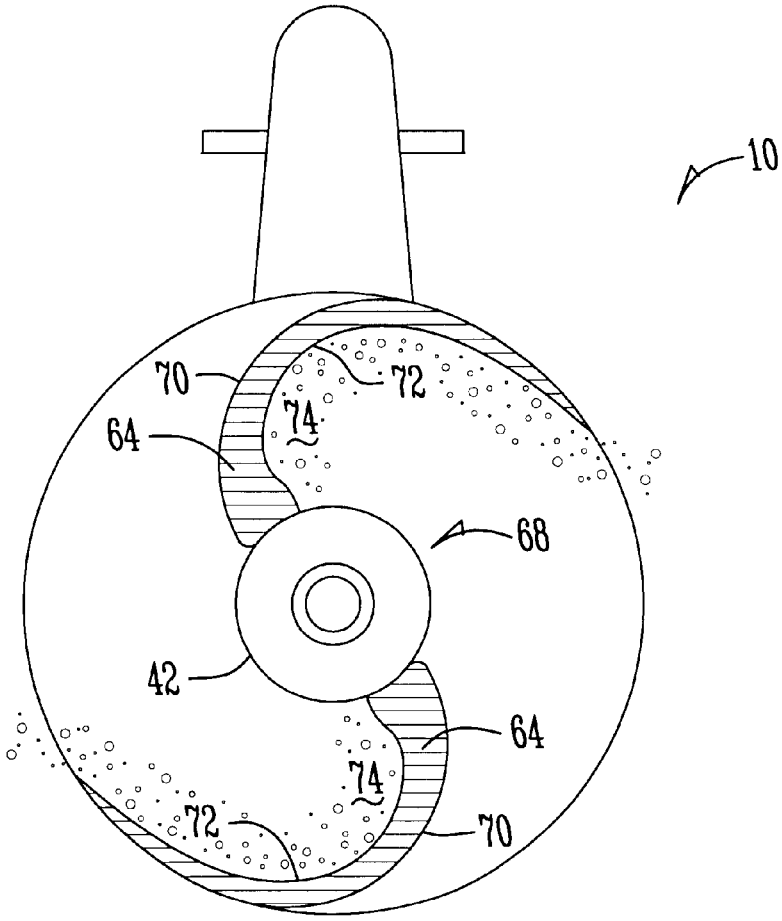
FIG. 3 is a cross sectional view of the supercavitator, or second stage 2-blade propulsor portion.

FIG. 3 shows an embodiment of the present invention, which is a supercavitation propeller 64 having two blades. The curved outer surface 70 of each blade 64 forms a volute curve wound spiral-like, beginning from the respective opposite points on the periphery of the water intake and each winding spirally around the intake in about 180 degrees, and the front edges 70, of the blades 64 is rounded so as to facilitate the smooth passing of any solid matters. As shown in FIG. 3, after the forward end portion of the inner surface 72 of blade 64 is wound in about 45 degrees along the periphery of the intake, the recess 74 is then radially formed on the inner surface 72 of the blade 64 from the point of 45 degrees from the front edge 70 whereby the incipient or initial cavitation is formed in the area of recess 74, and the initial cavitation grows along the inner surface 72 of each blade 64 to form a long and stable supercavitation and thereby to stabilize the liquid flow.

Figure 5:
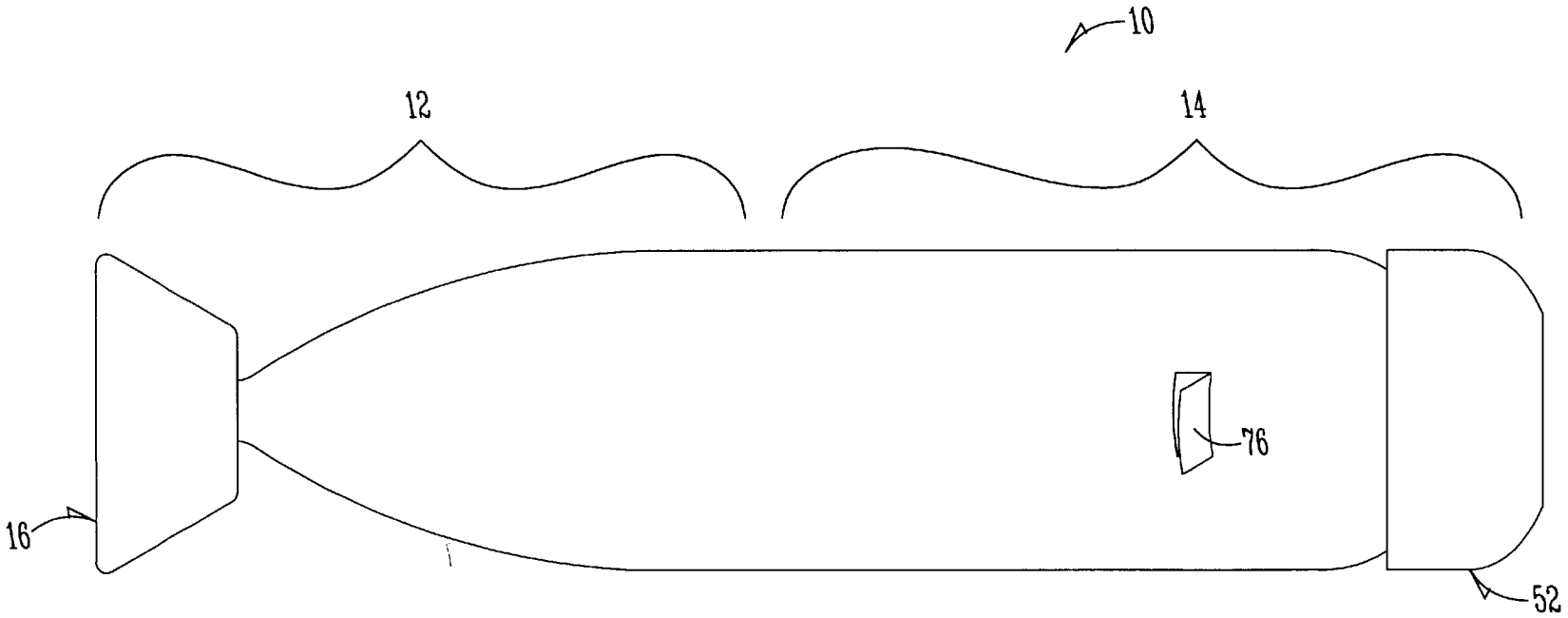
FIG. 5 longitudinal side elevational view showing a preferred embodiment of the submarine propulsion system.

The submarine bow and stem propulsion could be electric-powered (brushless). They could be turbine-powered, using steam, gas from a surface gas turbine, or even air-driven, like a high-speed dental hand piece (capable of very high revolutions per minute). High speed will be needed in the stage two vanes of the front propulsor; they create the supercavity. The vacuum-bubble supercavity contains only water vapor, offering almost zero surface drag. The submarine travels in a medium offering less resistance than air. The supercavity collapses back into liquid water after the submarine has passed. The supercavity is created from the water in front of the bow; that water would have otherwise produced the wave that limits the speed of all ships that move through the water. The exhaust gas that powers the stage two vanes may be used to supplement the supercavity, increasing its size and stability. Supercavity shape could be modified to provide clearance for turns by the use of increased cavity ventilation or retractable flap-like projections 76 (FIGS. 2 and 5) behind the nozzle region; these modifications could also be used for turning the craft. This feature on twin submarine propulsors should offer great maneuverability. It is possible that there will be space available in the submarine beyond that needed for the bow and stem propulsors. The submarine could hold batteries for electric power storage. In an alternate embodiment, all propulsion source of power would be located within the submarine(s), eliminating the gas turbine on the surface.

In the preferred embodiment, the speed of stealth is increased through the use of a pumpjet 52 in the bow 14 as a stage one propulsor. The stage one pumpjet 52 alone, not the stage two supercavitator 66, is selectively engaged for bow propulsion in stealth operation. The purpose of the stage one pumpjet 52 is to minimize cavitation, to the greatest possible extent, even during operation of the stage two spiral-blade supercavitator hub 66. Just as the rear pumpjet 16 increased stealth speed over the standard propeller on a submarine 10, the pumpjet 52 design provides pressure on blade areas to suppress cavitation, and eliminates blade tips (FIG. 1), also suppressing cavitation. The shroud 56 is attached to the propeller blades 54 and the entire system rotates from the hub 60 connected to the drive shaft. The shroud 56 may contain communication nozzles 78 within its structure that run from the pressure area behind the blades 54 to areas in front of the blades 54 (FIG. 1), to minimize cavitation and create a vortex effect. The vortex loop not only reduces blade cavitation, but it increases kinetic energy and acts as an impeller to increase speed, without further increase in power.

The pumpjet may 52 also contain communication nozzles 78 through the rotating pumpjet hub 60. Another alternate embodiment may also have the vortex loop system running through the structure of the propeller blades 54 themselves. There may be one or more loops through each blade 54, even including multiple perforations (not shown) throughout each blade 54 in cavitation-prone areas. The low-pressure cavitation-prone areas then communication with areas of higher pressure behind the blade (in the jet constriction) and resist formation of water vapor bubbles on the blade surface. The multiple-perforated form of cavitation suppression is somewhat different than that with the shroud-based vortex loop configuration (with a more clearly defined circular counterflow channel), in that a true vortex loop is less well defined. However, applications beyond vortex loops in water jets exists for any propeller-driven craft, using perforated propellers.

Figure 7C:
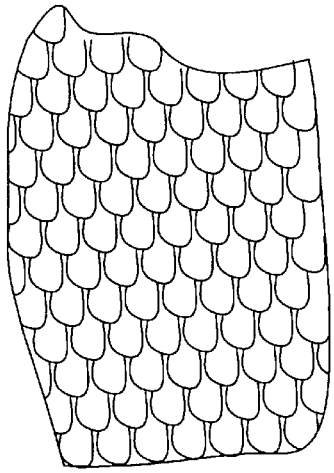
FIG. 7 illustrates a. surface texturing on a golf ball, b. small shingles on a roof, & c. sharkskin or fish scale surface texture.
Figure 7B:
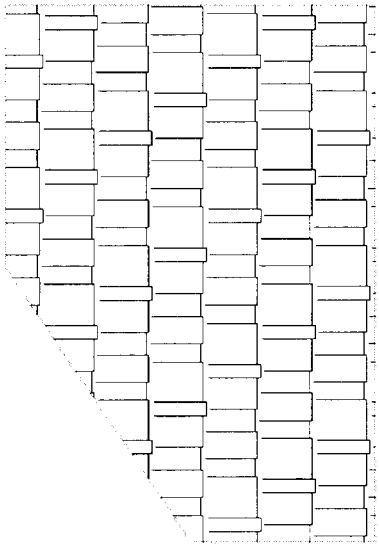
Figure 7A:
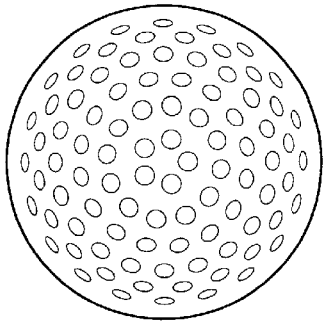

The speed of stealth is also increased by directing the water exiting the bowjet nozzle in a slightly diverged angle. This avoids jet contact with the exterior of the submarine propulsor and reduces boundary layer friction drag, while creating counter-current turbulence in a positive direction. In addition, drag could be further reduced by adding a surface texture treatment, examples of which are shown in FIGS. 7A, 7B, and 7C. This surface texturing can be applied on the rubber coating or anecholic tiles. It could be applied to another outer surface coating that is less likely to detach from the submarine body at normal cruising speed. A variety of surface textures can be applied, including a texture that resembles the skin of a shark or the small scales of a fish (FIG. 7C), texture like shingles on a roof (FIG. 7B), and texturing similar to the dimples on a golf ball (FIG. 7A). In this alternate embodiment, texture variation is targeted only to problem areas. For example, as the submarine 10 exterior contour begins to taper towards the stem 12 (FIG. 5), increasing the size of the scales or golf ball-like dimples will allow the flow of water to follow the submarine contour more closely, reducing the magnitude of the vacuum-like void that creates suction and leads to greater turbulence.

Smaller size texturing would be utilized in more forward areas along the hull where boundary layer drag problems interfere to a lesser degree. The surface drag is due to viscous shear forces of the moving water against the surface of the submarine, resulting in eddies and turbulence that cause deceleration, sapping the submarine's momentum. The turbulence and eddies increase with increase in submarine speed.

In another alternate embodiment, parallel longitudinal ridges, like those found on a phonograph record, would also allow the water to flow as close to the surface as possible, without touching it, thereby reducing the turbulence close to the surface. For example, 40 micron phonograph-like ridges in the middle area of the submarine and sail would create a shear-protected layer of similar magnitude, preventing eddies of high-speed fluid from contacting the surface. As the submarine 10 and sail taper toward the stern 12, the size of the texturing would increase, to duplicate the golf ball-dimple effect.

Yet another alternate embodiment that would help control the surface friction and prevent, or at least delay, the onset of turbulence and micro-cavitation phenomena, is a special material outer coating. Examples of this would be a fluid-backed rubber coating or a "mammal skin" polymer, that duplicates dolphin or whale skin hydrodynamics. In this case, variation in texture might be replaced or combined with polymer variation or varying fluid layers in the anecholic tile.

The surface texture treatment (FIG. 7) and front pumpjet 52 (FIG. 1), in combination with the stern pumpjet 9 (FIG. 5), provide higher speeds at stealth. The stem pumpjet contributes greatly to the management of turbulence behind the moving submarine 10. It minimizes the creation of a suction-like turbulent area, behind the moving submarine, which would pull it backward and slow forward progress. The suction turbulence is due to the pressure differential between the bow pressure wave and the stem slipwater area of lower pressure. This area of lower pressure is generated by the submarine's passage through the water, creating a void behind it. In other words, the elimination of some of the surface drag and wave drag that causes cavitation, combined with improved twin propulsion, raises the speed of stealth.

An alternate embodiment in FIG. 4 could operate as follows. Water would be moved at a high velocity by fan 30 at a rate greater than the flow of water into the inlet 26 of the submarine 10. Water at a higher velocity from the fan 30, is then passed by blades 40. The second set of straight, slightly angled blades 40 may or may not be counter rotating. Water accelerated at a greater velocity from the blades 40 is then passed into the nozzle region 50. Water at the higher velocity is thus exhausted out of nozzle region 50 as an exhaust jet to provide very high velocity water jet propulsion in a slightly diverged straight line.

At propeller blade 40 speeds greater than fifty meters per second, formation of a large supercavity is possible. Only the blades 40, not the vessel 10, need to move at this speed to generate the supercavity, making smooth transition to very high speed possible and practical. For example, a 12.2 meter wide sea wolf has a circumference of 38.33 meters. To reach blade speeds of 50 meters/second, it will require slightly more than one revolution per second in the second set of blades (60 rpm). Realizing that turbines such as a dental hand piece, can rotate at 400,000 rpm, supercavitation is not difficult to achieve. A simple model of a 2 centimeter wide dental hand piece fed by a garden hose in an aquarium has a 6.3 centimeter circumference. 1000 revolutions per second (60,000 rpm) will generate a supercavity. At high blade speed, supercavity generation would envelop the submarine 10 and minimize all surface friction beyond the shroud. This area would be in a water vapor filled vacuum. The drag or friction of the supercavity bubble is negligible.

Figure 6:
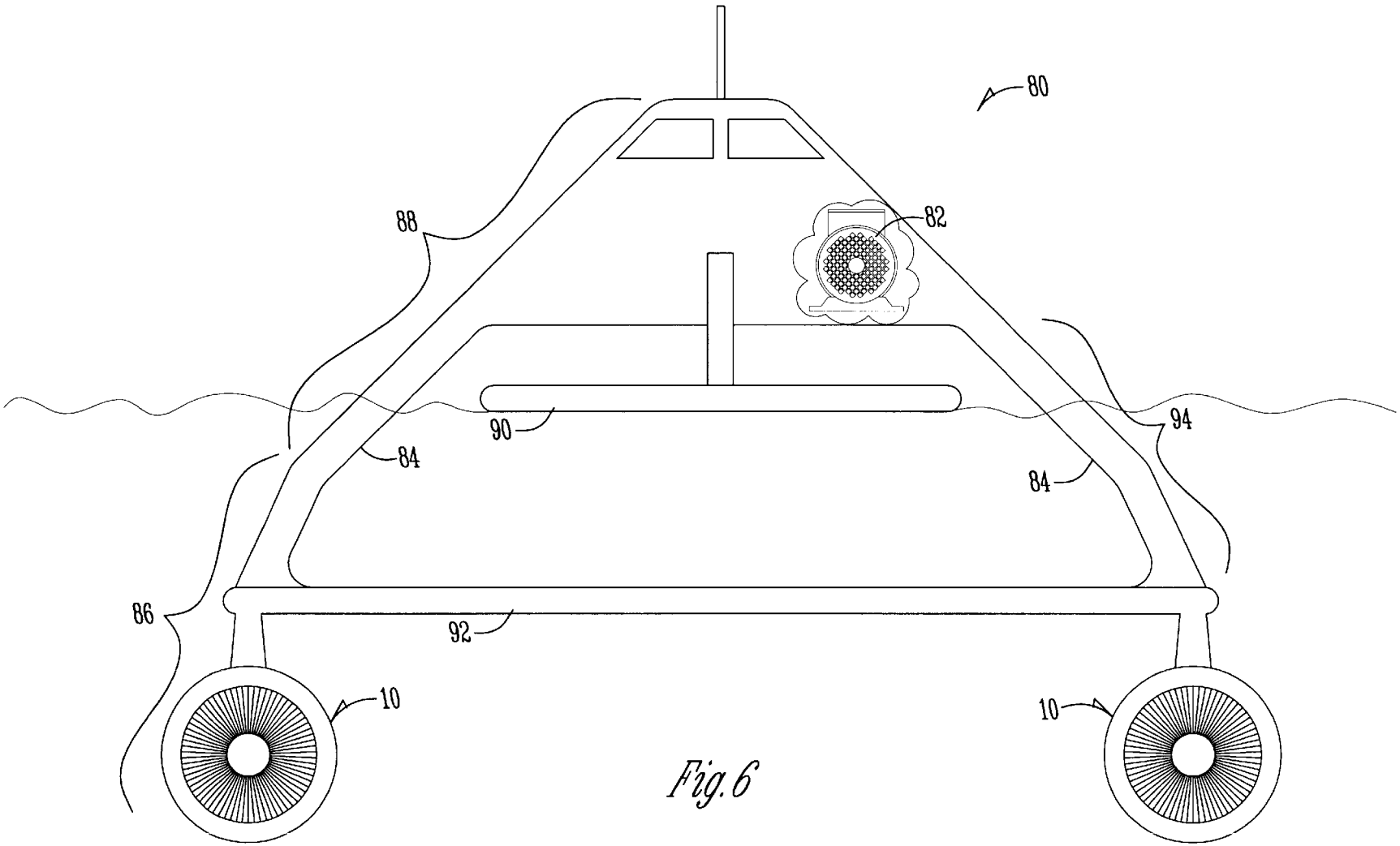
FIG. 6 is a pictorial fore view of a twin submarine powered hydrofoil surface craft.

As shown in FIG. 6, The surface vessel 80 houses the gas turbine power source 82 above the water, which generates electricity or gas, to respectively power the electric motors or turbines in the submarine(s)10. The turbines 82 on the surface may be utilized in a dual propulsion role above the surface, as long as it plays only a minor role. This could provide propulsion redundancy; however, care needs to be taken to minimize the top-heavy instability problem discussed earlier. Alternatively, diesel or another quieter power source could be used to power the electric generator for stealth propulsion.

The surface vessel 80 also contains the crew and the cargo. The surface vessel 80 design primarily considers stealth and seakeeping. The preferred embodiment would be a hull of SWATH (small waterplane twin hull) configuration as shown in FIG. 6. The twin submarines 10 would serve as twin submarine propulsors, each one below the catamaran-style twin hulls 84. The hull's waterplane area could also contain surface texture modification, or special material coating (e.g. "mammal skin" polymers) used to minimize surface drag on the submarine at stealth speeds. The surface vessel 80 is designed to reflect or absorb radar in a stealth-like manner, as in the Navy's 50-meter A-frame SWATH ship, SEA SHADOW, built by Lockheed. Cresting the tops of waves while transitioning into and out of foilborne operation points to deep vee forward and high dreadrise on the catamaran-style (waterplane) hull design 84. The hull portion 86 that is submerged at rest should be capable of maintaining buoyancy if the superstructure 88 is compromised. The superstructure 88 should be capable of maintaining buoyancy if the hull 84 is compromised. Under power, both could be compromised and the craft would not sink, maintaining position above the water from hydrofoil 90, 92 support. An alternate embodiment would utilize a mono-hull instead of a catamaran. Another embodiment would allow the surface vessel 80 the option of submerging, providing protection from a detected anti-ship missile. Prior to submerging, the surface vessel 80 would seal gas turbine communication 92 to the atmosphere. Ballast control, commonly known in the art, submerges the surface vessel 80. Once submerged, the stealth propulsors 10 would operate under battery power. It would then become a manned (sub-surface running) submarine.

Connecting the surface vessel 80 is a streamlined strut 92 that may be shaped as a hydrofoil of supercavitating and subcavitating capability; ideally, cavitation would be suppressed as much as possible to permit the highest possible speed of stealth. It may have surface treatment for drag reduction at stealth speeds, as discussed with the submarine and waterplane area of the surface vessel 80. The streamlined legs 94 attach catamaran-style twin submarine propulsors 10 (which are underwater while under power), in a manner that supports the superstructure 88 above the surface.

The mid-craft foil 92 is designed to support about 70% of the craft's weight while underway. It may also have dual-cavitating design. It may also have surface treatment for drag reduction at stealth speeds, as discussed with the submarine, surface craft waterplane area, and leg areas of the craft. The mid-craft foil connects the twin submarine propulsors 10 to one another; all remain constantly submerged. This mid-craft foil 92 and streamline/strut 94 may be hollow to act as a store for fuel, possibly utilizing buoyancy compensation. This is a safe location for fuel storage. The surface skimming or wave-piercing foils 90 will support the remaining 30%, or so, of the surface vessel 80 at speeds of stealth cruising and supercavitation high-speed running.

They may also have dual-cavitating design and surface treatment that reduces drag. This unique combination of constantly ventilating surface-shimming hydrofoils 90 with a submerged mid-craft foil 92 that never ventilates, has a cavitation advantage at stealth speed; it permits more foil area to be available for support of a larger surface vessel 80, permitting a larger loading prior to cavitation. The four hundred ton limit, discussed earlier, no longer applies. An alternate embodiment would place surface-skimming or wave-piercing foils 90 fore and aft of each twin hull 84. In this case, greater than 30% of the surface vessel 80 weight would be supported while underway. This would allow additional increase in craft size, without significant increase in mid foil size. The combination significantly out performs the lifting capability of using the surface-shimming hydrofoil 90 or the mid-craft hydrofoil 92 alone.

This is therefore believed to have accomplished all of the stated objectives of the invention including providing a reduction of drag caused by surface turbulence along the length of the craft (at stealth & supercavitating speeds); providing a reduction of drag caused by wave generation (at stealth & supercavitating speeds); providing higher speed of stealth, providing faster submarine propulsion, capable of generating a supercavity and traveling in it; providing fuel-saving high speed efficiency by lowering drag; providing a bow jet-drive submarine, using hydrofoils, to raise and propel a surface ship above the water; providing a combination of mid-craft foil and surface-skimming foils to increase the size and stability of the craft; providing a more stable propulsion system at all speeds, yet remaining maneuverable; providing a craft that is resistant to sinking with a compromised hull, superstructure, or propulsion system; providing a surface craft with increased stealth that can submerge and maneuver and providing a safer twin propulsor system, that has a safer fuel storage location.

It is to be further understood that the propulsion system is dynamically designed according to desired performance characteristics. The entire propulsion system must be water tight with respect to the interior of submarine. Configuration of the bow jet is similar to that used in present-day jet engines and is sometimes referred as a bypass flow nozzle. It is essentially a plug, which is placed in a cone-shaped object thereby restricting flow. A general description of the present invention as well as a preferred embodiment of the present invention has been set forth above. Those skilled in the art, to which the present invention pertains, will recognize and be able to practice additional variations in the methods and systems described, which fall within the teachings of this invention. Accordingly, all such modifications and additions are deemed to be within the scope of the invention, which is to be limited only by the following claims.

What is claimed is:

1. A propulsion system for a water vehicle, the water vehicle including an above surface portion and a submerged portion, the submerged portion including a body having bow and stem ends, the propulsion system comprising:

a first propulsion unit including a plurality of blades secured to a hub, being secured to the submerged portion at a location away from the stern;

a second propulsion unit including a plurality of blades secured to a hub, being secured to the submerged portion at the stern; and means for creating a supercavity.

2. The propulsion system of claim 1 wherein the first propulsion system is a pumpjet.

3. The propulsion system of claim 1 wherein the second propulsion system is a pumpjet.

4. The propulsion system of claim 1 further comprising:

a third set of curved blades rotationally secured to a third hub, the third hub being located between the hub of the first propulsion unit and the hub of the second propulsion unit.

5. The propulsion system of claim 1 further comprising:

flaps secured to the side of the submerged portion for maneuvering the vehicle.

6. The propulsion system of claim 1 further comprising:

a channel in a blade for circulating water from an area behind the blade to an area in front of the blade.

7. The propulsion system of claim 1 further comprising:

a shroud surrounding the first plurality of blades, the shroud including a channel for circulating water from an area behind the blades to an area in front of the blades.

8. The propulsion system of claim 1 wherein water flows from in front of the blades to an area behind the blades, the propulsion system further comprising:

a channel in the hub for circulating water from the area behind the blades to an area in front of the blades.

9. The propulsion system of claim 1 wherein a supercavity is formed, the propulsion system further comprising:

means for stabilizing the supercavity.

10. The propulsion system of claim 1 wherein the submersible includes a varied surface texture coating.

11. The propulsion system of claim 10 wherein the varied surface texture coating covers the entire submersible.

12. The propulsion system of claim 1 further comprising:

a hydrofoils secured to the submerged portion.

13. The propulsion system of claim 1 further comprising:

a hydrofoil secured to the submerged portion; and a wave piercing hydrofoil secured to the above surface portion.

14. A method for propelling a water vehicle including a non-submerged portion and a submerged portion, the submerged portion including a body with bow and stern ends, the method comprising:

operating a power source within the submerged portion;

rotating a first set of blades operatively connected to a first hub, the first hub being located away from the stern end of the submerged portion, said first hub being operatively connected to a power source;

rotating a second set of blades operatively connected to a second hub, the second hub being located at the stern end of the submerged portion, said second hub being operatively connected to a power source; and lifting the non-submerged portion by forcing water over a hydrofoil.

15. The method for propelling a water vehicle of claim 14 wherein the first set of blades are secured to a shroud.

16. The method for propelling a water vehicle of claim 14 wherein the second set of blades are secured to a shroud.

17. The method for propelling a water vehicle of claim 14 wherein the hydrofoil is a wave-piercing hydrofoil.

18. The method of propelling a water vehicle of claim 14 further comprising submerging the non-submerged portion.

19. A method of reducing the drag for propeller driven water craft, the method comprising:

turning a propeller in the water, the propeller having a plurality of blades secured to a hub;

removing water from an area downstream from the propeller blades; and inserting water into an area upstream from the propeller blades.

20. The method of reducing the drag for propeller driven water craft of claim 19 wherein a propeller blade includes a vortex loop.

21. The method of reducing the drag for propeller driven water craft of claim 19 wherein the hub includes a vortex loop.

22. The method of reducing the drag for propeller driven water craft of claim 19 wherein propeller blades are secured to a shroud.

23. The method of reducing the drag for propeller driven water craft of claim 22 wherein the shroud includes a vortex loop.

24. A propulsion system for a water vehicle, the water vehicle including an above surface portion and a submerged portion, the submerged portion including a body having bow and stern ends, the propulsion system comprising:

a propulsion unit including a plurality of blades secured to a hub, the hub being secured to the submerged portion; and a channel in a blade for circulating water from an area behind the blade to an area in front of the blade.

25. A propulsion system for a water vehicle, the water vehicle including an above surface portion and a submerged portion, the submerged portion including a body having bow and stern ends, the propulsion system comprising:

a propulsion unit including a plurality of blades secured to a hub, the hub being secured to the submerged portion; and a shroud surrounding the first plurality of blades, the shroud including a channel for circulating water from an area behind the blades to an area in front of the blades.

26. A propulsion system for a water vehicle, the water vehicle including an above surface portion and a submerged portion, the submerged portion including a body having bow and stern ends, the propulsion system comprising:

a propulsion unit including a plurality of blades secured to a hub, the hub being secured to the submerged portion; and a channel in the hub for circulating water from the area behind the blades to an area in front of the blades.

* * * * *